US007115075B2

(12) United States Patent
Johnston

(10) Patent No.: US 7,115,075 B2
(45) Date of Patent: Oct. 3, 2006

(54) MANEUVERABLE EXERCISE APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 16 days.

(21) Appl. No.: 10/966,077

(22) Filed: Oct. 14, 2004

(65) Prior Publication Data

US 2005/0075228 A1 Apr. 7, 2005

Related U.S. Application Data

(63) Continuation of application No. 10/355,981, filed on Feb. 1, 2003, now Pat. No. 6,921,358.

(51) Int. Cl.
*A63B 22/00* (2006.01)

(52) U.S. Cl. ..... 482/51; 482/131

(58) Field of Classification Search ..... 482/51–53, 482/57, 70, 79–80, 142, 146, 118, 131; 297/340
See application file for complete search history.

(56) References Cited

U.S. PATENT DOCUMENTS 4,391,441 A * 7/1983 Simjian ..... 482/131
4,948,124 A * 8/1990 Ghaly ..... 482/118
5,433,690 A * 7/1995 Gilman ..... 482/146
5,967,610 A * 10/1999 Lin ..... 297/340

* cited by examiner

*Primary Examiner*—Stephen R. Crow

(57) ABSTRACT

A maneuverable exercise apparatus is provided which enables the user to exercise both upper and lower body muscle groups. The apparatus includes a frame structure means, an upper body engagement means, and a lower body engagement means. The upper and lower body engagement means are coupled to the frame structure means. The user operates the apparatus while in a generally lying position. The user may push and pull backward and forward upon two handle members with their hands, which are part of the hand engagement means. This motion is transferred into a pivoting motion of the lower body engagement means, which is engaged by the legs of the user. Alternately, the user may pivot the lower body engagement means with their legs, and move said handle members of said upper body engagement means in the foward and backward directions. The lower body engagement means is pivotally coupled to the frame structure means such that the lower body engagement means may be pivoted in the forward, backward, and side directions.

10 Claims, 12 Drawing Sheets

MANEUVERABLE EXERCISE APPARATUS

CROSS-REFERENCE TO RELATED APPLICATION

This invention is a Continuation Application of U.S. application Ser. No. 10/355,981, filed Feb. 1, 2003 now U.S. Pat. No. 6,921,358.

BACKGROUND OF THE INVENTION

This invention relates to a manueverable exercise apparatus which has an upright structure that allows the user to perform both upper and lower body exercise routines while in a generally lying down position. This feature allows for a more comfortable and better upper and lower body workout than provided by more conventional combination exercise devices.

U.S. Pat. Nos. 5,441,472, 5,605,525, 6,273,841, and 6,475,120, which were all issued previously to the inventor, Gary Johnston, demonstrate similar types of exercise devices. However, they do not provide as much maneuverabiltiy as the invention described herewith, and thus do not provide as well of a complete exercise routine.

SUMMARY AND OBJECTS OF THE INVENTION

It is the object of this invention to provide an exercise apparatus which may provide the user a well balanced upper and lower body combination exercise routine. The main purpose of this application is to demonstrate an apparatus which performs the stated function, and to demonstrate the many options and configurations this apparatus may take on.

Briefly stated, the apparatus that forms the basis of the present invention comprises a frame structure means, an upper body engagement means, and a lower body engagement means. The upper body engagement means and the lower body engagement means are both mounted upon the frame structure means. Also, an optional resistance means may be supported by the frame means, and operatively connect to the upper body engagement means and/or the lower body engagement means.

The design of the apparatus is such that the upper body engagement means is comprises of two handle assemblies, each assembly pivotally mounted to the frame structure means so that the end the user engages with their hand pivots in the generally forward and backward directions, and the opposite end of the assembly pivots in the generally upward and downward directions. The lower body engagement means is pivotally mounted to the frame structure means such that it may pivot not only in the forward and backward directions, but also in the side directions. The upper body engagement means is operatively connected to the lower body engagement means so that pivoting movement in the upper body engagement means produces pivoting movement in the lower body engagement means, and vice versa. The user will position themselves in a genrally lying position on the frame structure means, and engage both the upper and lower body engagement means to operate the device. The user may pivot the upper body engagement means, and resist this motion with the lower body engagement means, or they may pivot the lower body engagement means and resist this motion with the upper body engagement means. A conventional type of resistance component may be added to the apparatus to provide an external resistance to the pivoting motion of the upper and lower body engagement means.

Other obects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
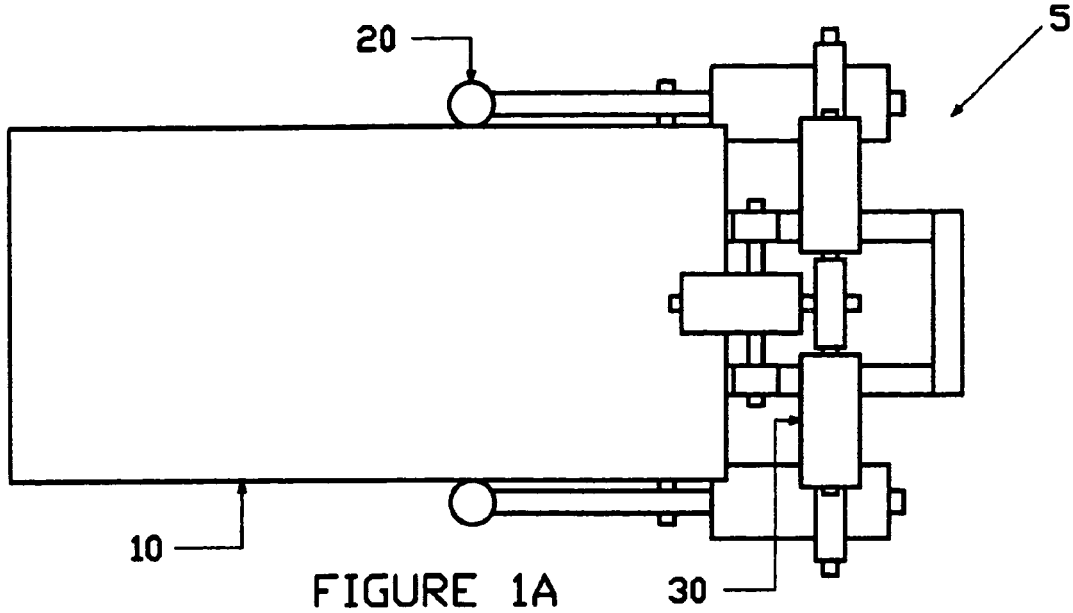
FIG. 1A is a top view of the maneuverable exercise apparatus.
Figure 1B:
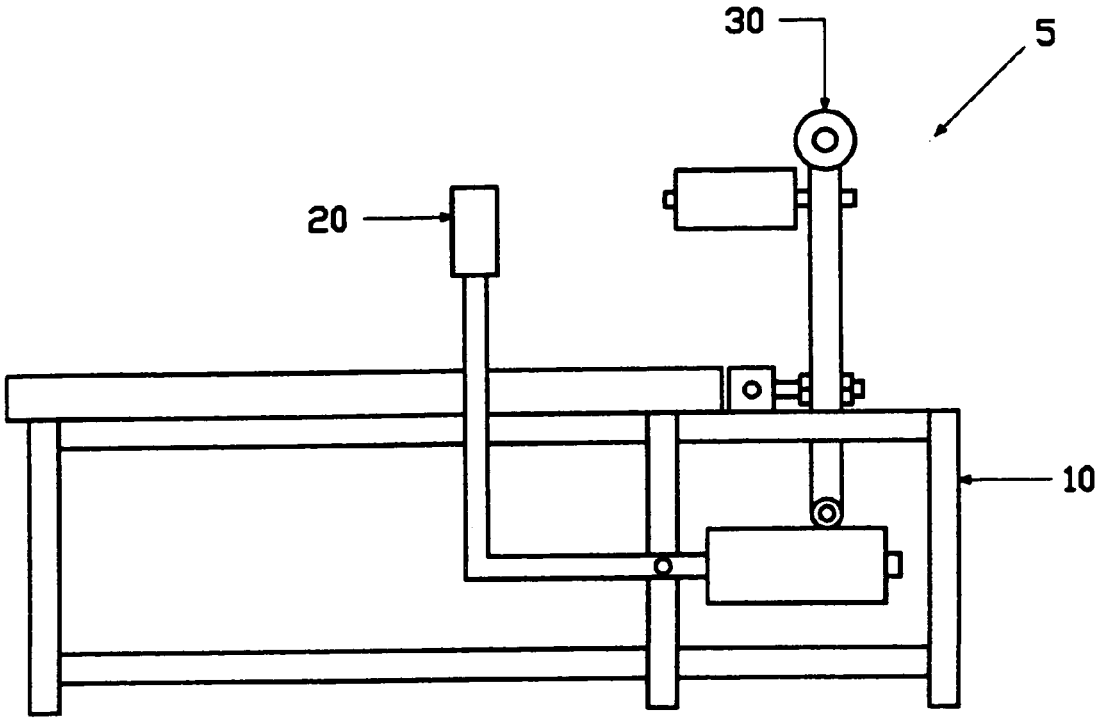
FIG. 1B is a side view of the maneuverable exercise apparatus.
Figure 1C:
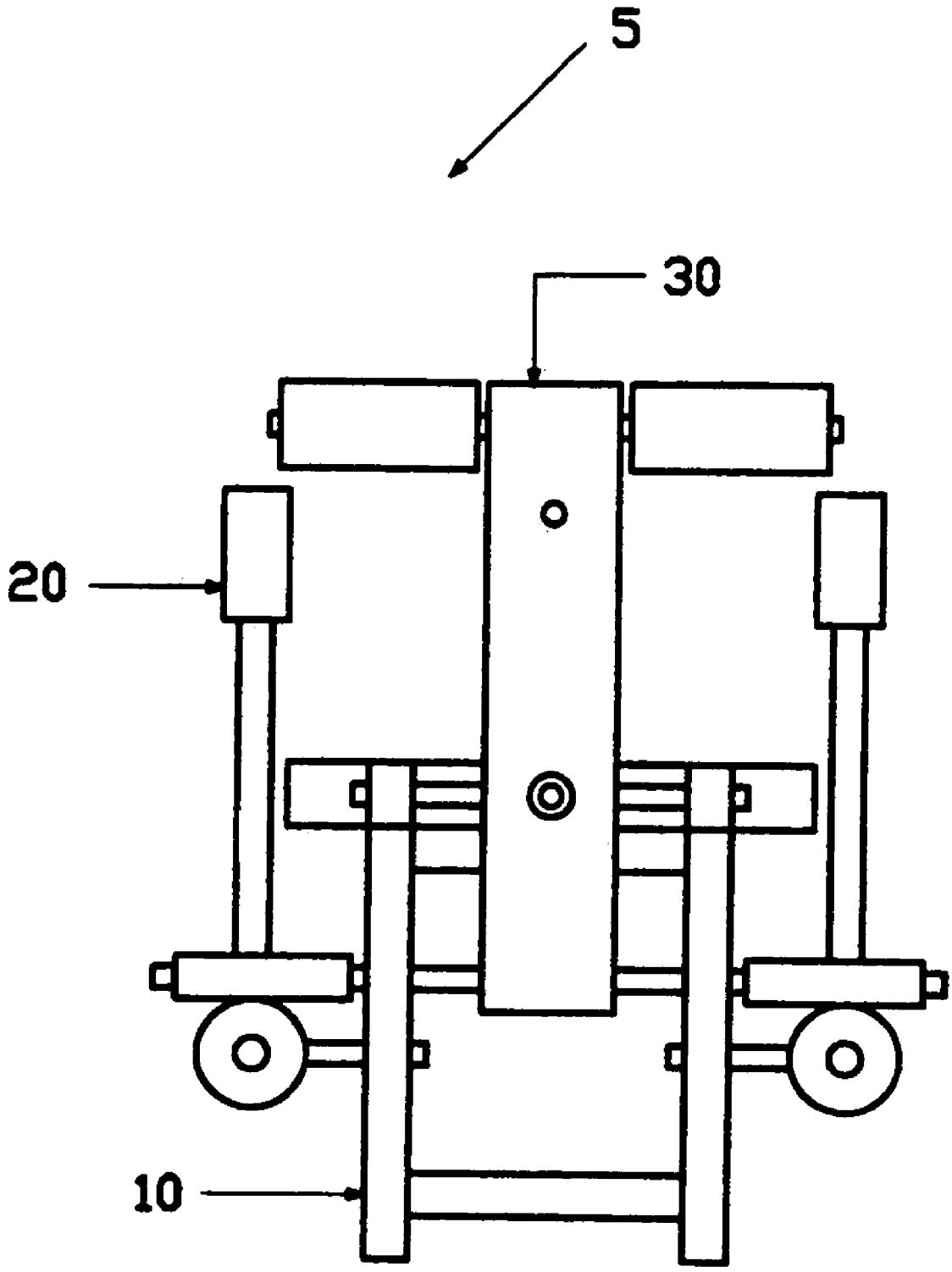
FIG. 1C is a front view of the maneuverable exercise apparatus.

As best can be seen by references to the drawings, and in particular to FIGS. 1A–1C, the maneuverable exercise apparatus that forms the basis of the present invention is designated generally by the reference numeral 5, and includes a frame structure means 10, an upper body engagement means 20, and a a lower body engagement means 30. The upper body engagement means 20 and the lower body engagement means 30 are both mounted on frame structure means 10.

Figure 2A:
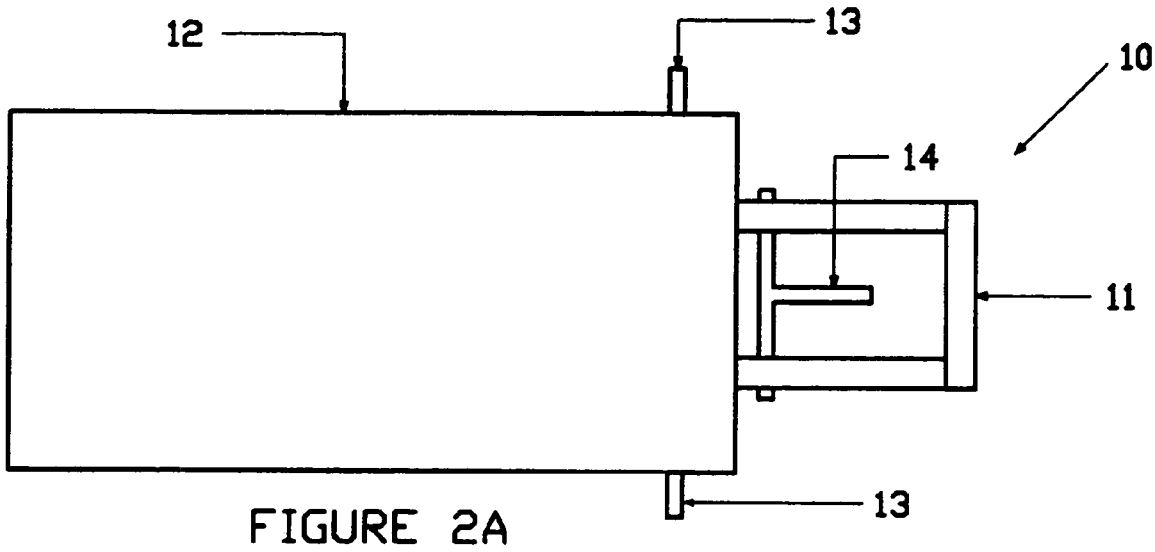
FIG. 2A is a top view of the frame means of the maneuverable exercise apparatus.
Figure 2B:
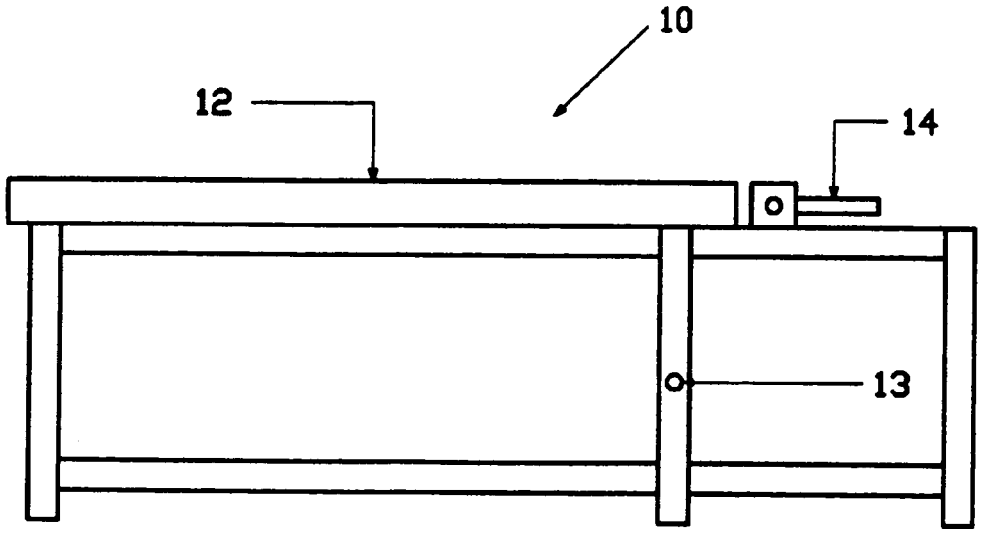
FIG. 2B is a side view of the frame means of the maneuverable exercise apparatus.
Figure 2C:
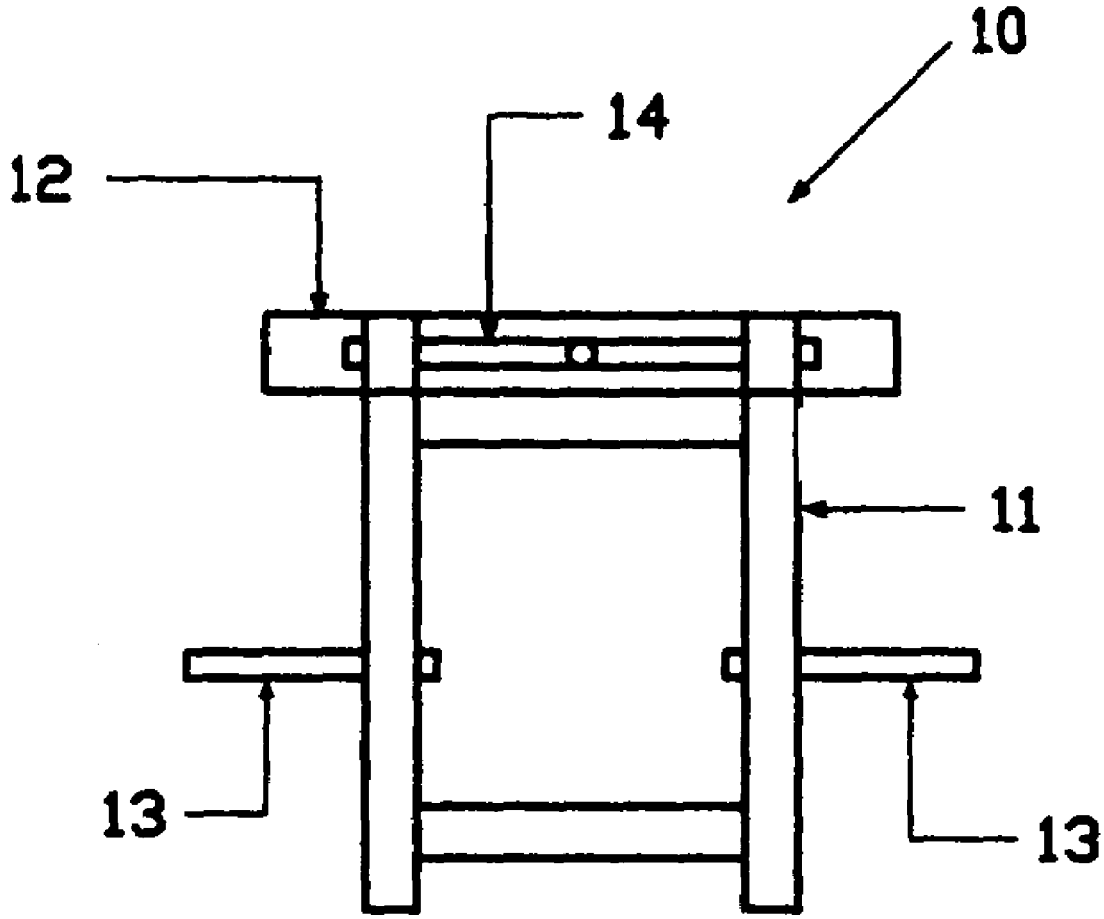
FIG. 2C is a front view of the frame means of the maneuverable exercise apparatus.

As may be seen in FIGS. 2A–2C, the frame structure means 10 comprises a base structure 11, a user support member 12, handle assembly connectors 13, and a lower body assembly connector 14. The handle assemblies of the upper body engagement means 20 pivotally mount to the handle assembly connector 13, while the lower body engagement means pivotally mounts to lower body assembly connector 14. Lower body assembly connector 14 pivotally mounts to the base structure 11.

Figure 3A:
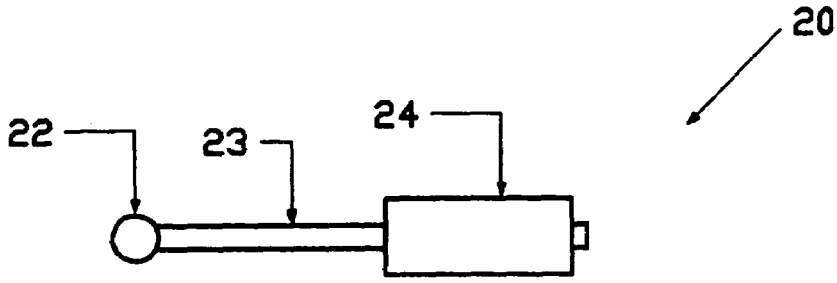
FIG. 3A is a top view of the handle assembly of the upper body engagement means of the maneuverable exercise apparatus.
Figure 3B:
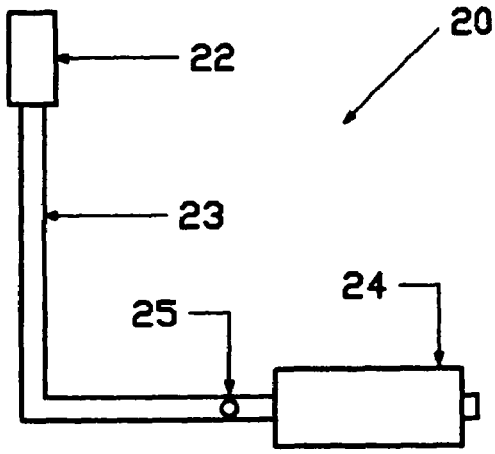
FIG. 3B is a side view of the handle assembly of the upper body engagement means of the maneuverable exercise apparatus.
Figure 3C:
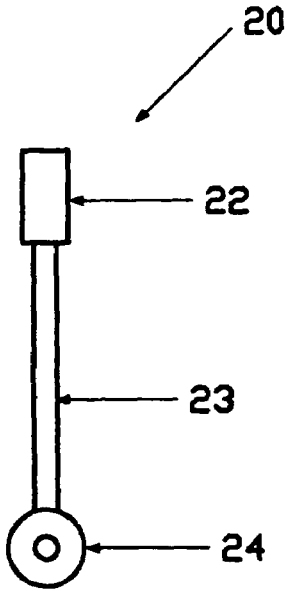
FIG. 3C is a front view of the handle assembly of the upper body engagement means of the maneuverable exercise apparatus.

As may also be seen in FIGS. 3A–3C, each handle assembly 21 of the upper body engagement means 20 comprises a hand engagement member 22, a support member 23 having opening 25, and a curved member 24. Handle assembly 21 mounts to the base structure 11 of frame strcuture means 10 via opening 25. The user will engage hand engagement member 22 with their hand during device operation. Curved member 24 may be a part of support member 23, or may be a separate component. Preferrably, curved member 24 is a separate component rotatably mounted to support member 23.

Figure 4A:
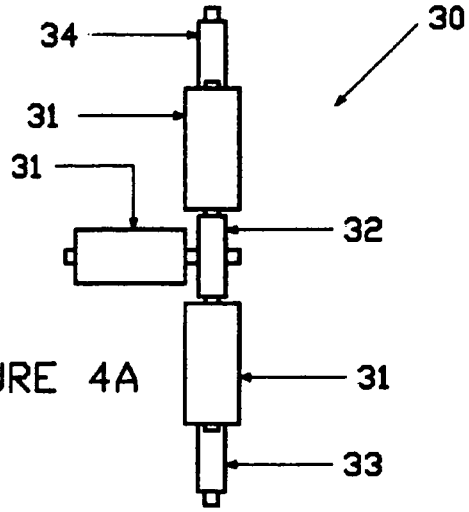
FIG. 4A is a top view of the lower body engagement means of the maneuverable exercise apparatus.
Figure 4B:
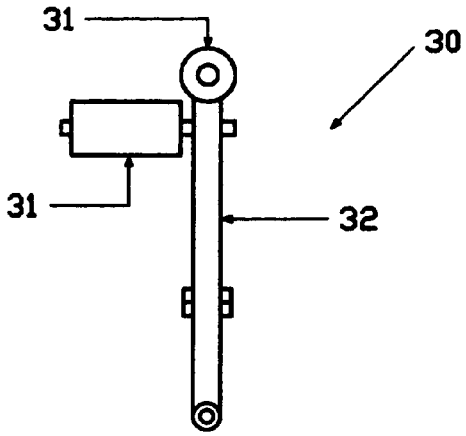
FIG. 4B is a side view of the lower body engagement means of the maneuverable exercise apparatus.
Figure 4C:
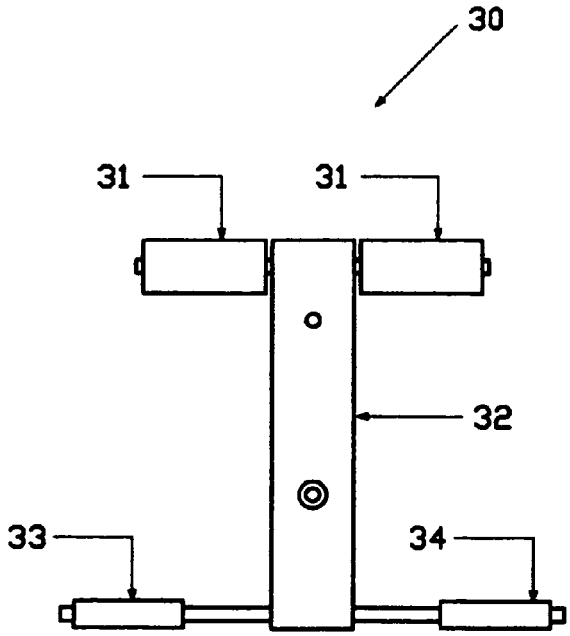
FIG. 4C is a front view of the lower body engagement means of the maneuverable exercise apparatus.
Figure 5A:
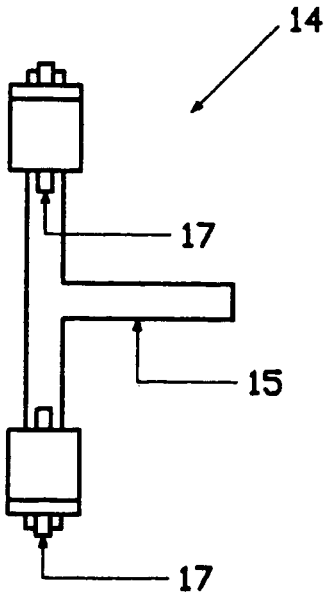
FIG. 5A is a top view of the lower body assembly connector of the frame structure means of the maneuverable exercise apparatus.
Figure 5B:
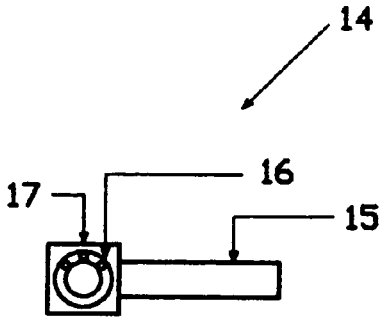
FIG. 5B is a side view of the lower body assembly connector of the frame structure means of the maneuverable exercise apparatus.
Figure 5C:
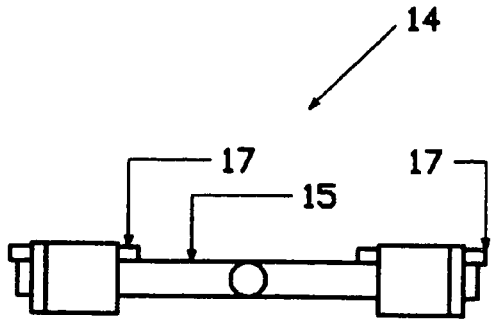
FIG. 5C is a front view of the lower body assembly connector of the frame structure means of the maneuverable exercise apparatus.
Figure 5D:
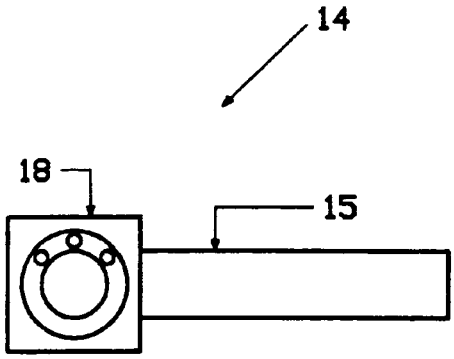
FIGS. 5D, 5E, and 5F are side views of the lower body assembly connector of the frame structure means, demonstrating several positions at which the assembly connector may be secured.
Figure 5E:
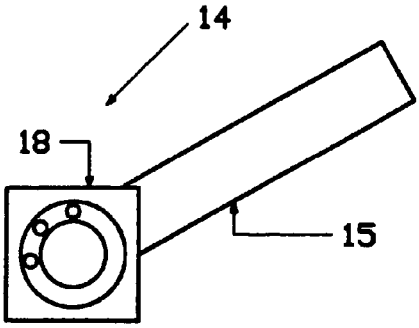
Figure 5F:
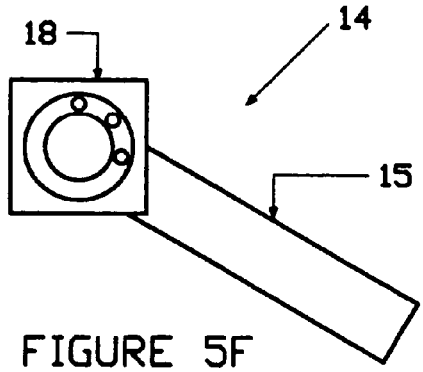
Figure 6A:
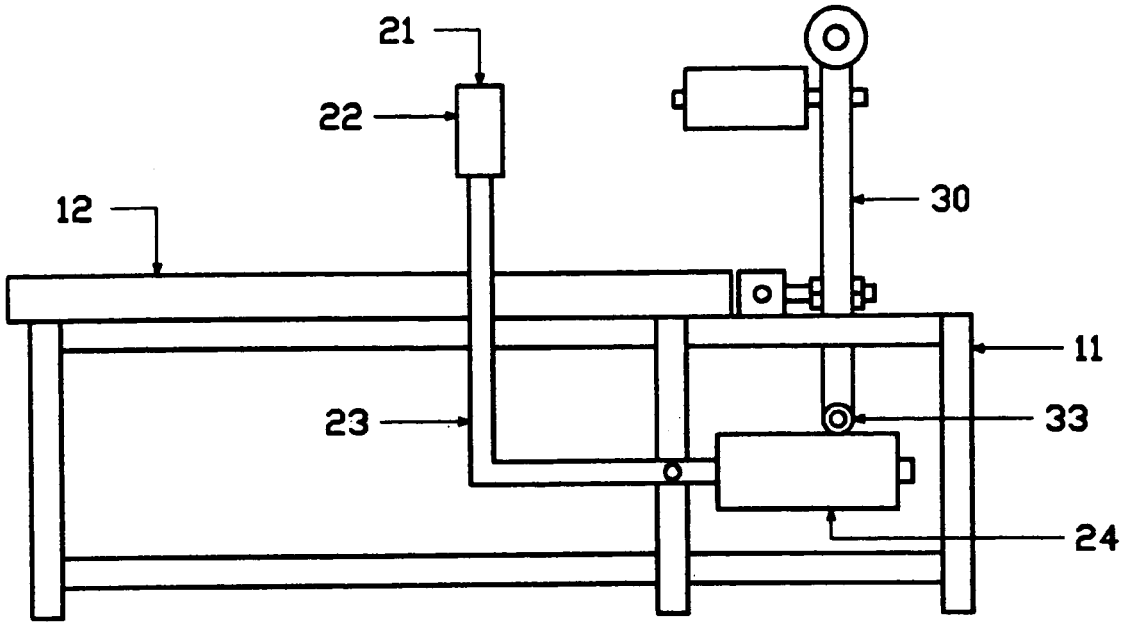
FIGS. 6A and 6B are side views of the maneuverable exercise apparatus, demonstrating how the upper body engagement means and the lower body engagement means are operatively connected so that pivoting motion in one will produce pivoting motion in the other.
Figure 6B:
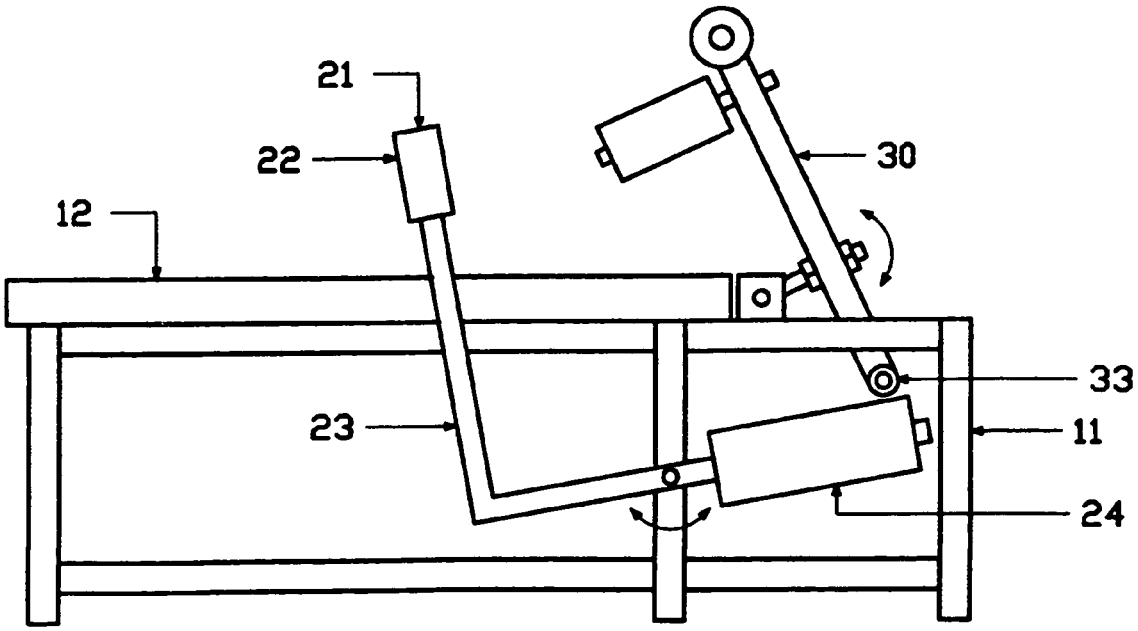
Figure 7A:
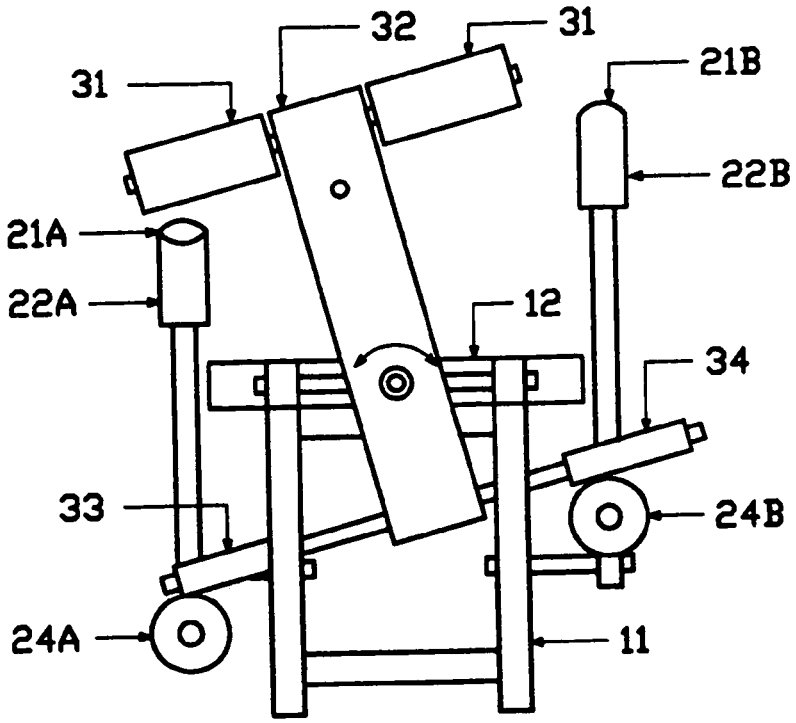
FIGS. 7A, 7B, and 7C are front views of the maneuverable exercise apparatus, demonstrating how the upper body engagement means and the lower body engagement means are operatively connected so that pivoting motion in one will produce pivoting motion in the other.
Figure 7B:
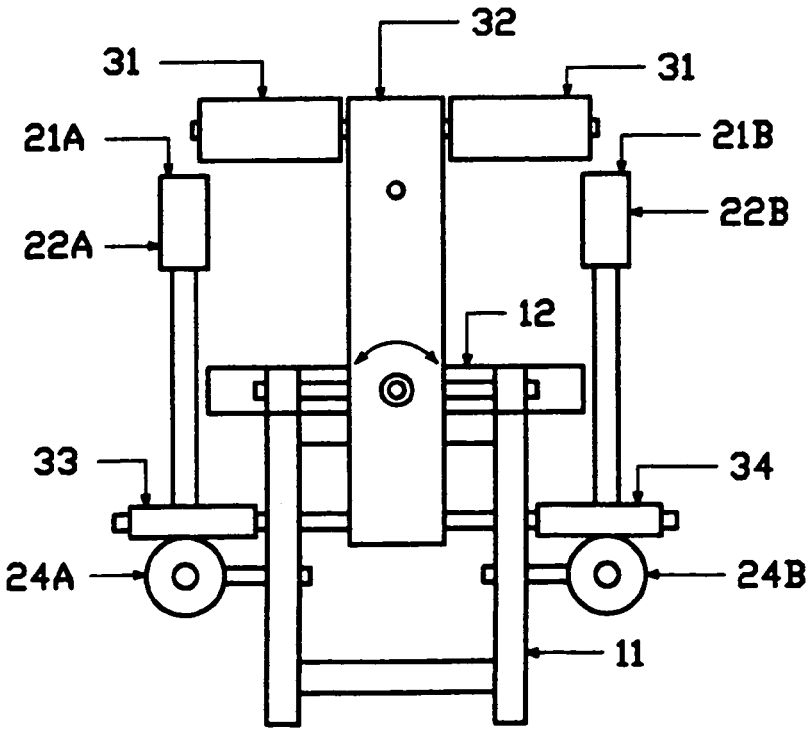
Figure 7C:
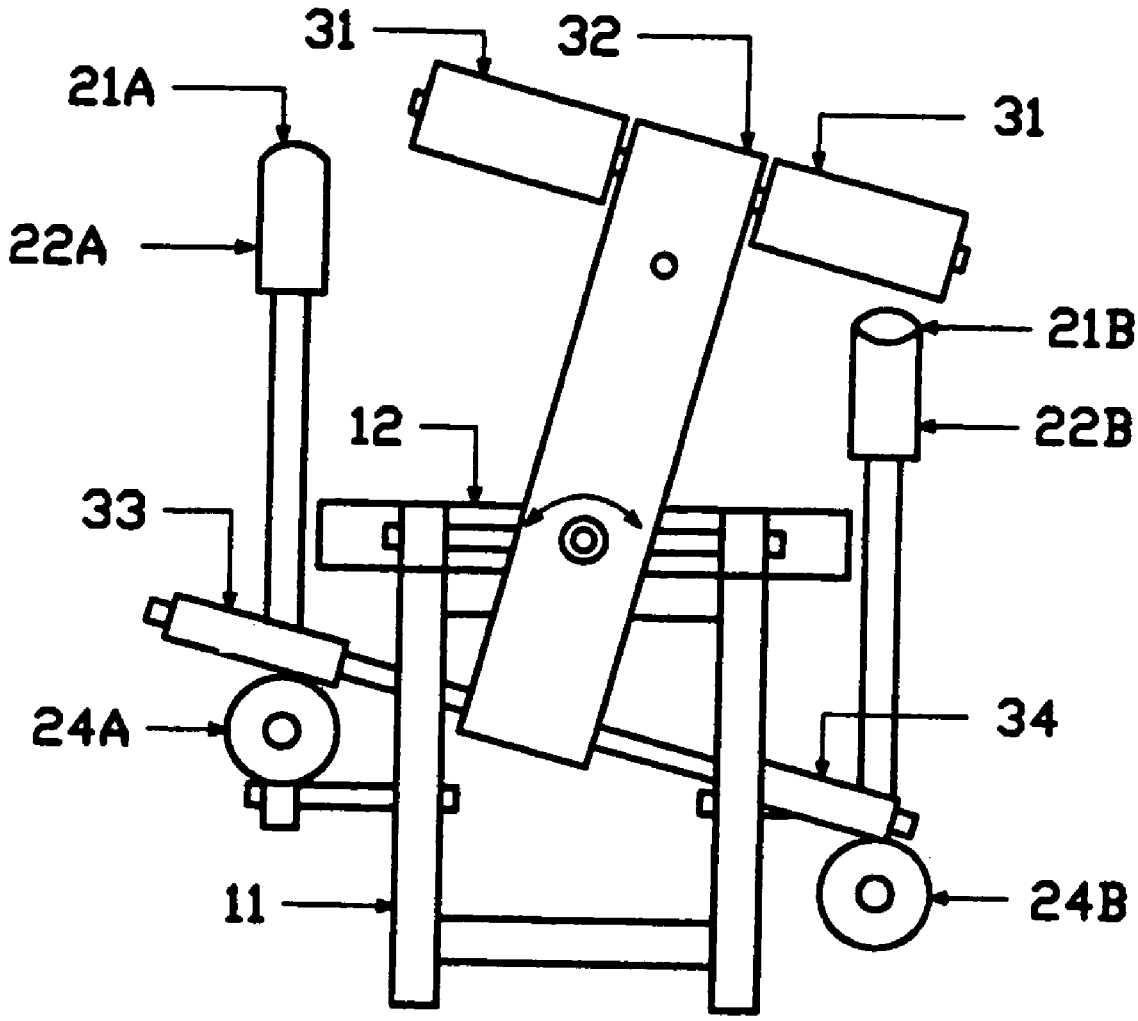

As may be seen in FIGS. 4A–4C, the lower body engagement means 30 is comprised of leg engagement assembly 31, support structure 32, right curved member 33, and left curved member 34. Leg engagement assembly 31 is mounted to the top of support structure 32, while right and left curved members 33 and 34 are mounted to the bottom of support structure 32. Support structure 32 has opening 35, which is used to mount the lower body enaggement means 30 to lower body assembly connector 14 of frame structure means 10. Curved members 33 and 34 extend in the generally outward directions. The user will engage the leg engagement assembly 31 with the general thigh area of the leg during device operation. Curved members 33 and 34 will engage curved members 24 of the upper body engagement means. As with the upper body engagement means, it is preferred that curved members 33 and 34 are rotatbly mounted to support structure 32.

As may be seen in FIGS. 5A–5F, the lower body assembly connector 14 of frame structure means 10 comprises a generally T-shaped mounting structure 15, which is pivotally mounted at two of its ends to support structures 18. Support structures 18 are rigidly mounted to base structure 11 of frame structure means 10. The lower body engagement means 30 mounts to the free end of lower body assembly connector 14 via opening 35 of support structure 32. Each end of mounting structure 15, which pivotally mount to support structure 18, may have a series of openings through which a pin or bolt may be place. A corresponding opening may also exist through support structure 18. Thus, mounting structure 15 may be secured at different angles to support structures 18. Otherwise, lower body assembly connector 14 may pivot freely within support structures 18.

The operation of the maneuverable exercise apparatus may be seen in FIGS. 6A–7C. The user will be lie on the user support member 12, which is mounted upon base structure 11, and engage said upper body engagement means 20 with their hands, and engage the lower body engagement means 30 with the general thigh portion of the legs. Hand assemblies 21A and 21B are pivotally mounted to the right and left side of the base structure 11, so that as the hand engagement members 22A and 22B are pivoted backward and forward, the associated curved members 24A and 24B pivot in the upward and downward directions. Curved members 24A and 24B of the upper body engagement means 20 operatively engage curved members 33 and 34 of the lower body engagement means 30.

Thus as the right hand engagement member 22A is pulled backward by the right hand of user, the associated right curved member 24A will move upward. Since right curved member 24A of the upper body engagement means 20 is in contact with the right curved member 33 of lower body engagement means 30, right curved member 33 will also move upward, causing the support structure 32 of upper body engagement means 30 to pivot to the left. Also, since left curved member 24B of the upper body engagement means 20 is in contact with the left curved member 34 of lower body engagement means 30, left curved member 34 will also move upward when the user pulls back upon the left engagement engagement member 22B with their left hand, thus causing the support structure 32 of upper body engagement means 30 to pivot to the right.

Since the support structure 32 of the upper body engagement means 30 is mounted to the lower body assembly connector 14, and lower body assembly connector 14 is pivotally mounted to base structure 11 using mount structure 15, the support structure 32 may also pivot in the foward and backward direction as the support structure 32 pivots in the side directions. If the lower body assembly connector 14 is rigidly mounted to the mount structure 15, instead of being pivotally mounted, the support structure 32 may only pivot in the side directions. This greatly increases the flexibility of the apparatus. The user may engage the leg engagement assembly 31 of lower body engagement means 30 with the general thigh area of the leg, and provide resistance to the pivoting motion of the handle assemblies through their lower body muscle groups.

The opposite may also hold true. The user may engage the leg engagement assembly 31 of upper body engagement means 30, and produce the pivoting motion of the support structure 32 of upper body engagement means in the foward, backward, and side directions. Again, the directions of pivot will depend upon whether or not the lower body connection assembly is rigidly or pivotally mounted to the mount structure 15. Thus, the user may engage the right and left hand engagement members with their hands, and provide resistance to the pivoting motion of the lower body engagement means with their upper body muscles.

As may also be seen, pulling backward upon right hand engagement member 22A will cause the support structure 32 of lower body engagement means 30 to pivot to the left. This causes left hand engagement member 22B to move in the forward direction. The opposite holds true in that pulling the left hand engagement member 22B in the backward direction will cause right hand engagement member 22A to move forward. However, the user may also pull backwards upon both the right and left hand engagement members 22A and 22B at the same time, and if the lower body assembly connected 14 is pivotally mounted to mount structure 15, the support structure 32 of upper body engagement means 30 will pivot backward. The user may pull backward upon the right and left hand engagement members 22A and 22B with a different force, so that the support structure 32 of lower body engagement means 30 may pivot backward and also towards the side of the smaller force.

As mentioned previously, it is desirable that both the right and left curved members 24A and 24B of the upper body engagement means are separate components which rotatably mount to the end of right and left support members 23A and 23B. It is also preferrable that right and left curved members 33 and 34 of lower body engagement means are separate components which rotatably mount to the support structure 32 of lower body engagement means 30. This is so that as the respective right and left curved members come in contact with one another, they roll against one another, and create a smooth motion. However, it is possible that the curved members 24A and 24B be an actual part of the support members 23A and 23B, and the curved members 33 and 34 be an actual part of support structure 32, but the movement of the respective curved member against one another will more than likely not be as smooth.

It is also possible to have an external resistance means operatively connected to the upper body engagement means and/or the lower body engagement means, to provide an external resistance to the pivoting motion of the right and left handle assemblies 21A and 21B, and the support structure 32. This may be any of the more common types of resistance components, such as a magnetic or electromagnetic flywheel, and have a convetional type of resistance knob. For example, a chain and sprocket assembly may mount to the apparatus, with one sprocket mounted on support structure 32 so that as the support structure 32 moves in the side directions, the sprocket will cause another sprocket, which is rigidly mounted to the resistance component, to also turn. The resistance component will also turn, and the amount of resistance in the resistance component can be varied by the resistance knob. The resistance component would need to be secured to the frame structure means so that it does not pivot in the side directions, but does pivot in the forward and backward directions. This could be accomplished by having an extended lower body assembly connector 14, upon which the resistance component would mount. The resistance component would pivot in the forward and backward directions, in conjunction with the lower body assembly connector. The resistance component would not pivot in the side directions, since the lower body assembly connector 14 does not pivot in the side directions. Therefore resistance will be felt by the user as they pivot both the upper and lower body engagement means, since they are operatively connected to one another.

Figure 8:
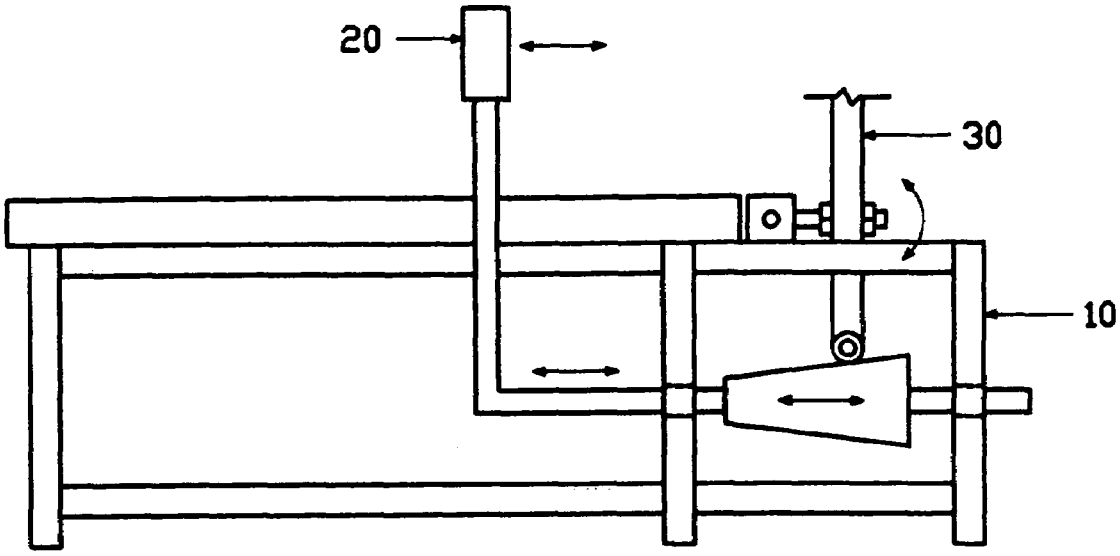
FIGS. 8 and 9 demonstrate additional versions of the maneuverable exercise apparatus, which perform generally the same function as the original version.
Figure 9:
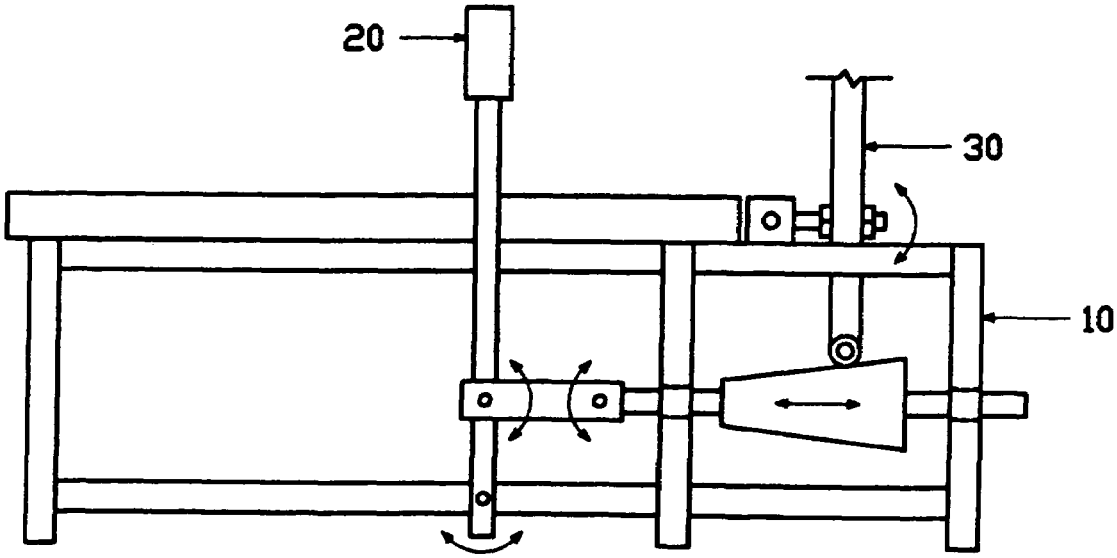

FIGS. 8 and 9 demonstrate additional version of the maneuverable exercised apparatus. FIG. 8 demonstrates a handle assembly which is coupled to the base structure so that it moves in the backward and forward direction, along a linear path. The curved members of the upper body engagement means have a changing contour, so that this version acts similar to the original version. As the user pulls back on the right handle assembly, the lower body engagement means 30 pivots to the left, and vice versa. FIG. 9 demonstrates still another version, in which part of the handle assembly is pivotally mounted to the base structure, while a second part is coupled to the base structure so that it only moves in the forward and backward directions. Again, the curved members of the upper body engagement means must have a changing contour for the device to operate as intended.

It is also possible to have changing contours on the curved members of the upper body engagement means and/or the lower body engagement means of the original version of the flexible exercise apparatus. This would allow the velocity and acceleration at which the hand engagement assemblies and the support structure pivot vary during the operation of the apparatus.

Many variations of the maneuverable exercise apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A maneuverable exercise apparatus comprising:

a frame structure means comprising a base structure with a user support member mounted thereon;

an upper body engagement means comprising a right handle assembly and a left handle assembly, said right handle assembly pivotally coupled to the right side of said base structure of said frame structure means, said left handle assembly pivotally coupled to the left side of said base structure of said frame structure means, each of said handle assemblies having a hand engagement member which pivots in the generally forward and backward directions;

a lower body engagement means comprising a generally upward extending support structure pivotally mounted to said frame structure means, said support structure having leg engagement members mounted to its top end, and right and left handle assembly engagement members mounted to its bottom end;

whereby said right handle member may engage said right handle assembly engagement member and said left handle member may engage said left handle assembly engagement member, such that moving said right handle member and said left handle member in the backward direction may produce pivoting motion of said support structure of said lower body engagement means in the backward direction, and pivoting of said support structure of said lower body engagement means in the forward direction may produce pivoting motion of said right and left handle members in the forward direction; whereby a user may position themselves in a generally lying position on said user support member of said frame strcuture means, engage said upper body engagement means with their hands, engage said lower body engagement means with their legs, and use the upper body engagement means to produce pivoting motion in said support structure of said lower body engagement means and alternately use said lower body engagement means to produce pivoting motion in said handle members of said upper body engagement means.

2. The maneuverable exercise apparatus as claimed in claim 1 further comprising an engagement support member pivotally coupled to the forward end of said base structure of said frame strcuture means such that the pivoting motion of said engagement support member is in the generally upward and downward directions; said support structure of said lower body engagement means coupled to said engagement support member so that it pivots in conjunction with said engagement support member, said support structure being pivotally coupled to said engagement support member in such a manner that said support structure may also pivot in the side directions.

3. The maneuverable exercise apparatus as claimed in claim 1, said right and left handle assemblies further comprising a support structure and a curved member, said support structure being a generally L-shaped member pivotally coupled to said base structure of said frame structure means, said hand engagement member mounted to one end of said support structure, said curved member mounted to the opposite end of said strcuture, whereby pulling said hand engagement member in the backward direction produces upward movement of said respective curved member.

4. The maneuverable exercise apparatus as claimed in claim 1, said handle assembly engagement members of said lower body engagement being outwardly extending curved members, said curved members of said lower body engagement means operatively engaging said curved members of said upper body engagement means.

5. The maneuverable exercise apparatus as claimed in claim 1 further comprising a resistance commponent which is used to provide a resistance to the movements of said upper and lower body engagement means.

6. The maneuverable exercise apparatus as claimed in claim 3, said curved members of said lower body engagement means being rotatably mounted to said support structure of said lower body engagement means.

7. The maneuverable exercise apparatus as claimed in claim 1, said right and left handle assemblies further comprising a support structure and a curved member, said support structure being a generally L-shaped member slideably coupled to said base structure of said frame structure means, said hand engagement member rigidly mounted to one end of said support structure, said curved member rotatably mounted to the opposite end of said structure member, whereby pulling said hand engagement member in the backward direction produces backward movement of said respective curved member, said curved member having a varying contour.

8. The maneuverable exercise apparatus as claimed in claim 6, said curved members of said lower body engagement means being rotatably mounted to said support structure of said lower body engagement means.

9. The flexible exercise apparatus as claimed in claim 1, said right and left handle assemblies further comprising a support structure and a curved member, said support structure being slideably coupled to said base structure of said frame structure means, said hand engagement member pivotally mounted to one end of said support structure through a connection means, said curved member rotatably mounted to the opposite end of said structure member, whereby pulling said hand engagement member in the backward direction produces backward movement of said respective curved member, said curved member having a varying contour.

10. The maneuverable exercise apparatus as claimed in claim 8, said curved members of said lower body engagement means being rotatably mounted to said support structure of said lower body engagement means.

* * * * *